United States Patent [19]

Brown

[11] 4,258,631

[45] Mar. 31, 1981

[54] STACKABLE COLLAPSIBLE SHIPPING RACK

[76] Inventor: John E. Brown, 10300 Chades Limpus Rd., Orlando, Fla. 32706

[21] Appl. No.: 29,110

[22] Filed: Apr. 11, 1979

[51] Int. Cl.[3] ..... A47B 43/00

[52] U.S. Cl. ..... 108/91; 108/53.5; 108/109

[58] Field of Search ..... 108/91, 53.5, 56.1, 108/111, 109; 211/149, 188, 194, 195; 182/152, 163

[56] References Cited

U.S. PATENT DOCUMENTS

| | | | |
|---|---|---|---|
| 753,598 | 3/1904 | Lyon | 108/109 |
| 1,772,213 | 8/1930 | Francois | 182/163 X |
| 2,354,906 | 8/1944 | Bailey et al. | 182/152 |
| 2,699,911 | 1/1955 | Chase et al. | 108/53.5 |
| 3,499,398 | 3/1970 | Murray | 108/53.5 |
| 3,565,018 | 2/1971 | Jay | 108/53.5 |
| 3,665,869 | 5/1972 | Howe | 108/53.5 |
| 4,098,409 | 7/1978 | Massey | 108/53.5 |

FOREIGN PATENT DOCUMENTS

| | | | |
|---|---|---|---|
| 2248204 | 5/1975 | France | 108/56.1 |

*Primary Examiner*—Francis K. Zugel
*Attorney, Agent, or Firm*—John Cyril Malloy

[57] ABSTRACT

A collapsible shipping rack with removable shelves being sized and configured for having one rack on top of another similar rack when the rack is in either the upright and collapsed position respectively. The rack includes a base, a plurality of substantially identical, normally upright legs connected to the base and each leg including a bottom section with positioning means, a middle section having at least one hinge means, and a top section having positioning means for compatible mating engagement with the bottom section positioning means. Additionally, a plurality of substantially parallel guide means are provided which span the legs for supporting the shelves.

6 Claims, 7 Drawing Figures

STACKABLE COLLAPSIBLE SHIPPING RACK

FIELD OF THE INVENTION

This invention relates generally to a rack and more particularly to a shipping rack which is capable of being collapsed and stacked when the shipping rack is either in its normally upright position or when the shipping rack is in its collapsed position.

BACKGROUND OF THE INVENTION

It has long been recognized that an easy convenient and relatively inexpensive way to transport food stuffs and the like (for example, such crushables as tomatoes) from one point to another can be achieved through the loading of shipping racks with the articles and then placing those articles in a motor conveyance or the like. In the past there have been shipping racks which have been suitable for this task and have done the job relatively efficiently. However, on the return trip the racks themselves were the only cargo unless food stuffs or the like were also able to be carried in the same racks because the racks were in fact not suited to all purposes. The carrier could not make the return trip with bulk goods and the like because the cargo space was occupied by the racks. Hence, the cost of delivery was higher than it needed to be if a way could be found to effectively utilize the return trip. Additionally, time, money, and energy was accordingly wasted and in general inefficiently utilized.

The applicant has provided a device wherein the shipping racks are stackable and collapsible such that in their collapsed position they take up only a fractional portion of the space that they took up when they were in their normally upright position. In this manner, the carrier or the like may transport foodstuffs and the like on the trip and bulk goods and the like on the return trip, with the racks taking up only a minimum of space. Thusly, the return trip can be used for transporting goods as well as the rack and thereby effectively utilizing the carrier's energy and other resources.

Overall, the invention is of great importance since it relates to the field of saving energy. As the President has recently noted, new and effective ways to save energy must now be found and it is of grave national concern that it be done so immediately. This invention is of that field and should be accordingly given judicious treatment.

OBJECTS OF THE INVENTION

One object of this invention is to provide a stackable shipping rack capable of being collapsed and stacked in either its collapsed or upright positions.

Another object of this invention is to provide a collapsible shipping rack with guide means wherein the guide means are suitable for supporting shelves and the like.

Another object of this invention is to provide a collapsible shipping rack wherein there are four legs and each leg has a bottom, middle, and top section and the middle section has at least one hinge means on each leg.

Another object of this invention is to provide a collapsible shipping rack wherein the shipping rack includes a base having guide means.

Another object of this invention is to provide a collapsible shipping rack of generally rectangular shape.

Another object of this invention is to provide a collapsible shipping rack wherein the middle section collapses towards the bottom section such that no portion of the middle section crosses the center line of the base.

It is a general object of this invention to provide a shipping rack of the type described generally herein and which is well adapted for the purposes which are set forth herein.

In accordance with these and other objects which will become more apparent hereinafter, the instant invention will now be described with reference to the accompanying drawings in which:

DESCRIPTION OF PREFERRED EMBODIMENT

Figure 1:
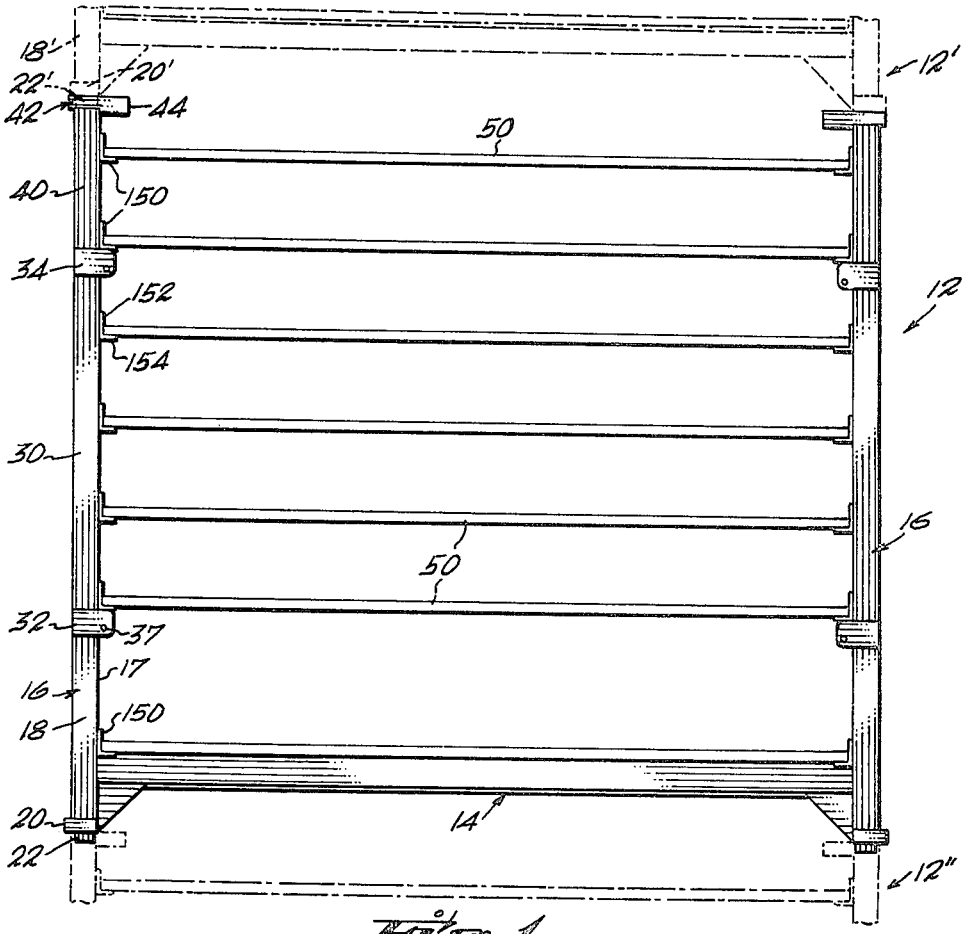
FIG. 1 is a frontal elevational view of the collapsible shipping rack shown with the legs in an upright position.

Referring to the drawings wherein like reference characters designate like or corresponding parts throughout the several views and referring particularly to FIG. 1, there is shown the invention generally designated by the numeral 12. As can be seen from FIG. 1 there is shown another rack 12' positioned atop rack 12. Additionally rack 12 is positioned on top of another rack 12''. The collapsed rack includes a base generally designated by the numeral 14 spanning legs 16.

The legs include a bottom section 18 with a terminal end 20 having positioning means 22. The positioning means are sized and configured for mating and confining engagement with the top end of another collapsible rack such as 12'' as will be explained more fully hereinafter.

The legs include a middle section 30 having hinge means such as at 32 and 34. As shown in FIG. 1 there are a pair of hinge means on each leg spaced approximately the same distance on each leg from the terminal end. However, as can be readily appreciated by one skilled in the art there may be two or more hinge means or as few as one hinge means on a leg.

The legs include a top section 40 having a top terminal end 42 with positioning means 44. The positioning means 44 is sized and configured for compatible engagement with the bottom section positioning means 22 of another collapsible rack. As shown in FIG. 1 the collapsible rack 12' having a bottom section 18', a terminal end 20' and a positioning means 22' fits compatibly on top of top terminal end positioning means 44.

Figure 2:
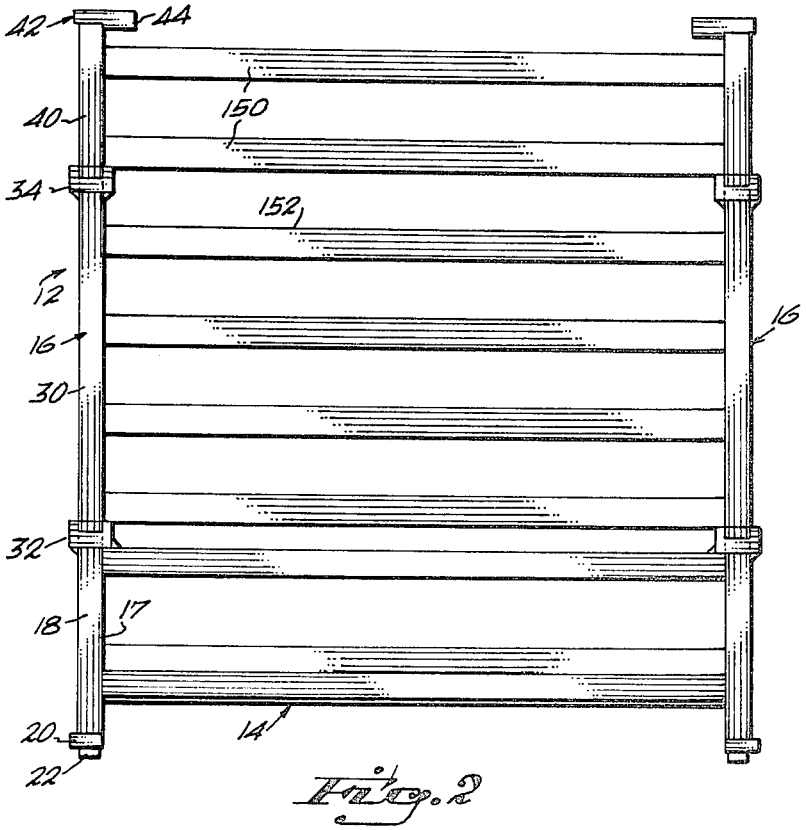
FIG. 2 is a side elevational view showing the invention in its upright position.

As shown in FIG. 2 the collapsible rack includes guide means such as those at 150 spanning leg 16. The guide means may be of any suitable material and by spanning the legs and the guide means give the collapsible rack added strength. As will be readily appreciated by one skilled in the art, the guide means may be of various sizes and configurations for accommodating the shelving as will be explained more fully hereinafter. The guide means depicted in the embodiment shown in FIG. 1 are generally elongate right angle brackets spanning legs 16 as shown in FIG. 2 having a backing portion 152 and a bottom portion 154 orthogonal to the backing portion. The guide means are spaced apart approximately an equal distance in the embodiment shown in FIG. 2. As will be readily appreciated by one skilled in the art this need not be the case but rather it is helpful in illustrating applicant's invention.

With particular reference to the embodiment shown in FIG. 1, there is shown the shelving 50 in mating engagement with the guide means 40. As shown in the embodiment depicted in FIG. 1, the base 14 can also accommodate a shelf when it is supplied with guide means such as those at 150. It will be noticed that in this embodiment the guide means are spaced approximately double the spacing of the other guide means. As will be readily appreciated by one skilled in the art, this need not be the case and guide means can be included along that portion of the leg denoted by the numeral 17. However, when the base is equipped with a guide means spaced approximately double the distance that the other guide means are spaced apart from one another, the rack can be collapsed easily as will be explained more fully hereinafter.

Figure 3:
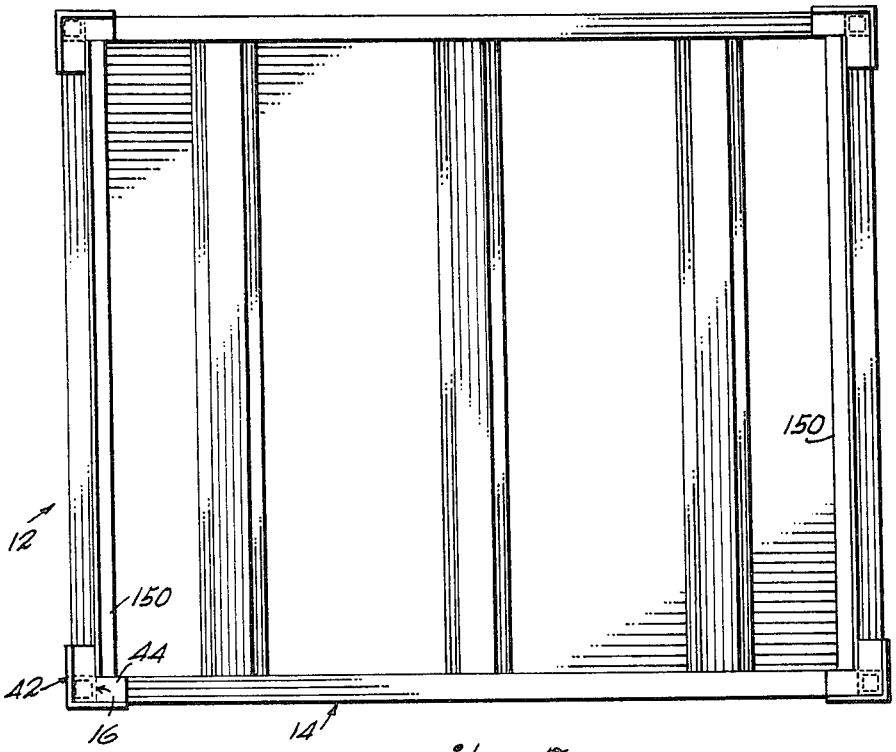
FIG. 3 is a top plan view of the invention.

With particular reference to FIG. 3, there is shown the top view of the collapsible rack 12. The rack is shown as a generally rectangular figure, however other configurations and sizes are possible as will be readily appreciated by those skilled in the art.

Figure 4:
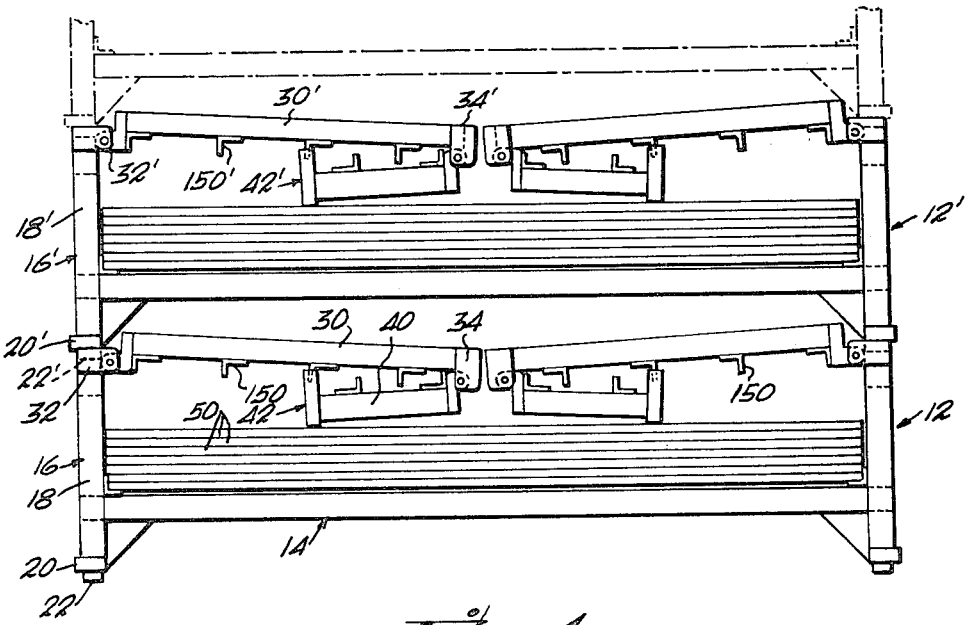
FIG. 4 is a frontal elevational view showing the invention in its collapsed position with one collapsed rack on top of another.

With particular reference to FIG. 4, there is shown the rack in one collapsed position with another rack on top of it. Rack 12' is shown atop rack 12 with the positioning means 22 engaging the inside surface of the hinge means of 12 as will be explained more fully hereinafter. The top section of leg 16 is collapsed at hinge 34 and is folded toward the middle section 30. The middle section 30 is collapsed at hinge 32 and folded toward the bottom section 18. The shelves 50 may be removed from the guide means 40 and placed on top of the base which may be provided with its own guide means as previously explained.

As shown in the embodiment of the invention depicted in FIG. 4, the top section 40 is collapsed until the terminal end 42 and is in abutting relation with the guide means 40. As will be readily appreciated by those skilled in the art, the guide means 150 depicted in FIG. 4 need not be present and the terminal end of the top section may be sized and configured such that the top section may abut the middle section more closely with another point of the top section abutting the middle section.

The middle section is collapsed at hinge 32 as previously explained and is folded with the bottom section and reaches a point where the middle section is generally parallel with the base 14 as depicted in FIG. 4. As will be readily appreciated by those skilled in the art, the shelves 50 may be removed and the middle section will fall further toward the bottom section 18 and the middle section will be closer to the base. In fact, the middle section and the top section may be sized and configured such that the sections are in abutting relation with the base as will be readily appreciated by those skilled in the art.

Figure 5:
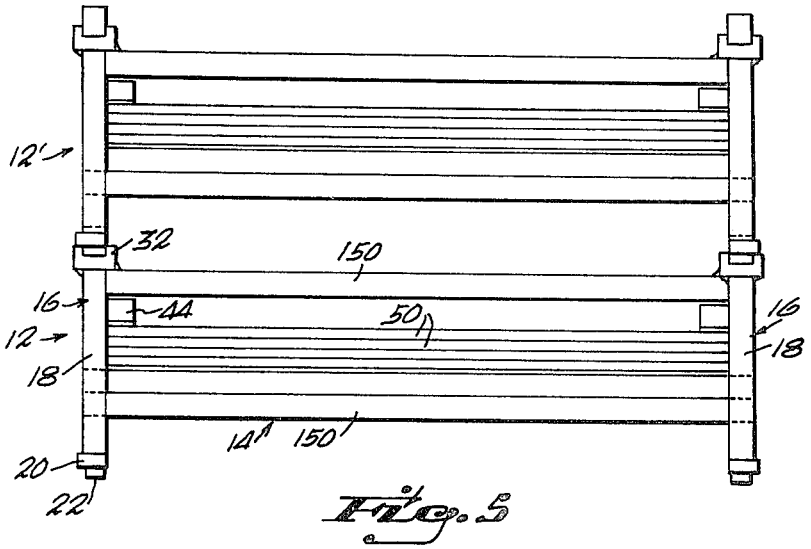
FIG. 5 is a side elevational view showing the rack in a collapsed position with one container on top of another.
Figure 7:
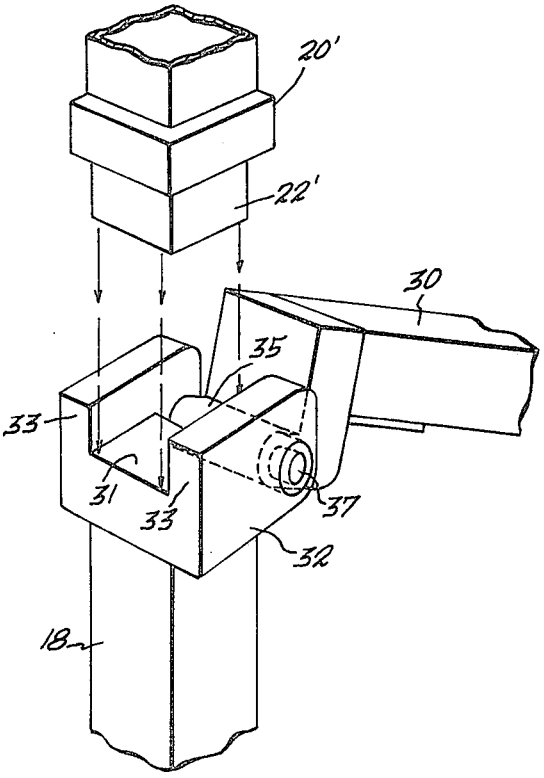
FIG. 7 is a partially exploded perspective view of one rack in a collapsed position with the bottom connection end of another rack mating with the inside surface of the hinge of the collapsed rack.

With particular reference to FIG. 7, there is shown the hinge 32 with the middle section 30 in the collapsed position. The middle section includes a roller pin means 35 having two ends 37 connecting to either side of the hinge 32 such that the middle section is hingedly captivated for collapsible rotation at hinge 32. The terminal end of the bottom section of another container 20' is shown with positioning means 22' about to be engaged at hinge 32 of the other container. The hinge 32 includes an abutment surface 31 with side walls 33. The positioning means 22' is placed on top of the abutment surface 31 and is captivated by hinge side walls 33 so that one rack may be put on another collapsed rack as shown in FIGS. 4 and 5 where there is shown collapsible rack 12' in a collapsed position on top of collapsed rack 12.

Figure 6:
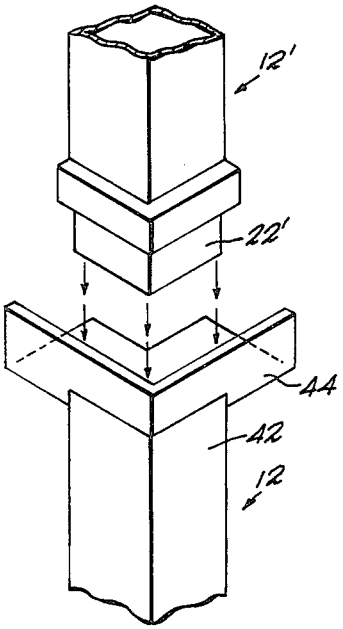
FIG. 6 is a partially exploded perspective view of the bottom connection end of one rack mating with the top connection end of the next rack.

With particular reference to FIG. 6, there is shown an enlarged view of the bottom terminal end of rack 12' having positioning means 22'. The rack 12' is about to engage the top section of rack 12 as shown in FIGS. 4 and 5. The collapsible rack 12 includes a terminal end 42 having positioning means 44. The positioning means of each rack are sized and configured for mating and captivating engagement with one another. The positioning means 22' engages the positioning means 44 as shown in FIG. 1.

In Use

In use the collapsible racks may be in their upright position for carrying various goods with the guide means serving as shelving supports and the shelves serving as supports for the items to be carried. When the goods are emptied at the destination point, the shelving 50 may be removed from the guide means and placed wherever convenient. One convenient place is at the base 14 when the base is provides with guide means. Other places may be equally suitable. The container can then be collapsed as at hinges 34 and 32 so that the container is in a collapsed position where it takes up far less room than in the upright position. The racks have been provided with stacking capability when in their collapsed and upright positions for easy transporting and efficient use of space.

As seen in FIG. 4, the space taken up by the collapsed rack is a small fraction of what it is as when the rack is erect. In this manner the truck or other moving conveyance on its return trip can used to move other goods in the space vacated by the collapsed rack.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A stackable collapsible shipping rack with removable shelves said rack being sized and configured for stacking on top of another similar rack in both the upright and collapsed position respectively, the rack comprising:

a base, a first and second pair of normally upright legs of a predetermined length connected to the base, each leg including;

a bottom section having a terminal first end with first positioning means, a middle section, a top section having a terminal end with second positioning means for compatible mating engagement with the first positioning means of another rack for stacking of the racks, and a pair of hinge means, the first hinge means connected at the juncture of the bottom and middle sections and the second hinge means connected at the juncture of the middle and top sections, each hinge means swingable inwardly to an open storage position and upwardly to a closed operational position, the first hinge means having an upper surface defining an abutment surface, sized and shaped for compatible interengagement with another rack's first positioning means and exposed when the hinge means is in the open or stored position, and a plurality of substantially parallel guide means spanning each pair of legs and the guide means defining shelf guide means for supporting shelves, the middle section having a perdetermined length which is approximately equal to but slightly less than half the distance between the first and second pairs of legs so that when the rack is in the storage position, the collapsed middle support sections do not cross one another and the top section is folded between the middle sections and the removable shelves in stored position on said base, and said shelves, when supported on said guide means, preventing the inward swinging of said hinge means.

2. The device as in claim 1 wherein the guide means comprise generally elongate members having a back portion and a bottom portion orthogonal to the back portion and orthogonal to the legs of each pair defining an elongate right angle bracket, suitable for supporting shelves.

3. The device as set forth in claim 1 wherein the base is generally rectangular as seen in plan.

4. The device as set forth in claim 4 wherein the base includes shelf guide means.

5. The device as set forth in claim 1 or 4 wherein the base shelf guide means are spaced apart a distance approximately twice the predetermined distance of the other guide means.

6. The rack as set forth in claim 1 wherein each hinge means comprises a roller pin hinge means.

* * * * *